United States Patent [19]

Wills

[11] 4,173,053

[45] Nov. 6, 1979

[54] CLEANING APPARATUS

[76] Inventor: Robert N. Wills, 5018 E. Townsend, Fresno, Calif. 93727

[21] Appl. No.: 937,464

[22] Filed: Aug. 28, 1978

Related U.S. Application Data

[63] Continuation-in-part of Ser. No. 757,203, Jan. 6, 1977, Pat. No. 4,115,891.

[51] Int. Cl.[2] ..... A46B 13/04

[52] U.S. Cl. ..... 15/71; 134/152

[58] Field of Search ..... 15/56–58, 15/65, 70–76, 101; 134/143, 149, 166, 152

[56] References Cited

U.S. PATENT DOCUMENTS

| | | | |
|---|---|---|---|
| 1,076,066 | 10/1913 | Runnels | 15/72 |
| 1,302,481 | 4/1919 | Spruch | 15/73 |
| 3,992,745 | 11/1976 | Laurila | 15/72 |

FOREIGN PATENT DOCUMENTS

| | | | |
|---|---|---|---|
| 1218501 | 5/1960 | France | 15/56 |

*Primary Examiner*—Edward L. Roberts
*Attorney, Agent, or Firm*—Huebner & Worrel

[57] ABSTRACT

An apparatus for cleaning containers and having a housing; a rotary cleaning mechanism mounted within the housing; a drive assembly for rotating the cleaning mechanism about an axis of rotation; a grasping assembly, having portions movable between grasping and release positions, borne by the apparatus for holding a container to be cleaned in a position about the cleaning mechanism substantially concentric to the axis; and a pressure system connected to the grasping assembly operable selectively to move the portions of the grasping assembly between the grasping and release positions.

10 Claims, 7 Drawing Figures

CLEANING APPARATUS

CROSS REFERENCE TO A RELATED APPLICATION

This application is a continuation-in-part of copending U.S. patent application Ser. No. 757,203, filed on Jan. 6, 1977, now U.S. Pat. No. 4,115,891, on an invention entitled, "CLEANING APPARATUS".

BACKGROUND OF THE INVENTION

1. Field Of The Invention

The present invention relates to a cleaning apparatus and more particularly to such a cleaning apparatus which is particularly well suited to the cleaning of containers bearing paint, lacquer and the like affording the capabilities of precisely and dependably grasping and retaining containers within the apparatus during cleaning, rapidly removing substances in a preliminary cleaning action where they have hardened or are otherwise particularly difficult to remove, and exhausting toxic, flammable, or explosive fumes from the apparatus so as to reduce the risks involved to an absolute minimum.

2. Description Of The Prior Art

In cleaning devices of a variety of types, it is frequently difficult securely and precisely to position the object to be cleaned relative to the cleaning mechanism. Where precise positioning is not achieved, inadequate cleaning results and in some cases damage to the objects and/or to the cleaning mechanism result. In such devices, it is often necessary in order to avoid this problem laboriously to position and to align the object to be cleaned with the cleaning mechanism. This is both tedious and inefficient and frequently results in the operator simply accepting improper positioning. In other instances, the substances to be removed from the object adhere tenaciously to the surface making cleaning both difficult and time consuming. Still another difficulty encountered in the use of prior art devices is that of minimizing the risk of injury particularly where hazardous cleaning solvents are employed.

Therefore, it has long been known that it would be desirable to have a cleaning apparatus permitting the rapid, dependable and precise alignment of objects to be cleaned with the cleaning mechanism, permitting the object to be held in such precise alignment during the cleaning operation, affording the capability of loosening or removing substances which have hardened into position; and reducing to an absolute minimum the risk of injury to operators of such equipment even where hazardous solvents are employed.

SUMMARY OF THE INVENTION

Therefore, it is an object of the present invention to provide an improved cleaning apparatus affording an efficiency and dependability of operation not heretofore available.

Another object is to provide such a cleaning apparatus which permits objects to be cleaned to be positioned rapidly, precisely and dependably in the apparatus for cleaning and to retain such objects fixed in the precise position selected during operation of the apparatus.

Another object is to provide such a cleaning apparatus which allows such precise positioning and grasping of the object to be cleaned in the device from a location remote from toxic or explosive solvents employed in the apparatus.

Another object is to provide such a cleaning apparatus which is adjustable to vary the grasping pressure exerted on an object to be cleaned thereby making it adaptable to grasp a wide variety of types of objects.

Another object is to provide such a cleaning apparatus which affords the capability of pre-cleaning such objects for the loosening or removal of hardened substances prior to the primary portion of the cleaning operation.

Another object is to provide a cleaning apparatus permitting such pre-cleaning wherein the substances removed are isolated from the solvent employed during the primary cleaning operation thereby permitting the solvent to be used for a substantially longer period of time.

Another object is to provide such a cleaning apparatus which possesses the capability of removing toxic, flammable and explosive fumes from the apparatus and transmitting them to a remote location for release.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
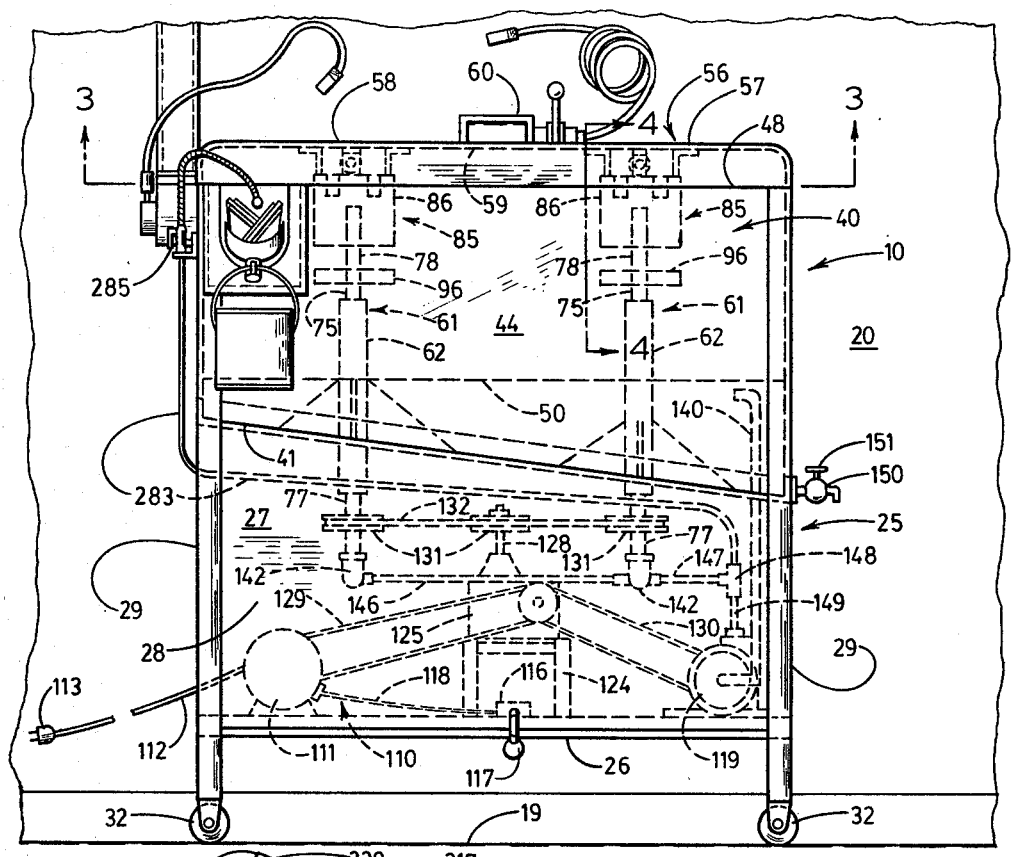
FIG. 1 is a front elevation of the cleaning apparatus of the present invention shown in a typical operative environment.

Referring more particularly to the drawings, the cleaning apparatus of the present invention is generally indicated by the numeral 10 in FIG. 1. As noted in the applicant's copending patent application Ser. No. 757,203, the cleaning apparatus of the present invention can be adapted for use in cleaning objects of a wide variety of shapes and sizes. However, the apparatus is particularly well suited to the cleaning of containers, such as indicated at 11 in FIGS. 4 and 6, which are typical of the type employed in mixing paint, lacquer and other such substances. The container 11 has a circular bottom panel or wall 12 with an interior surface 13. A cylindrical side wall 14 is integral with the bottom panel and has an interior surface 15 and an exterior surface 16. The cylindrical side wall of the container has an annular lip 17 which defines a mouth or opening 18 for the container remote from the bottom wall.

Figure 2:
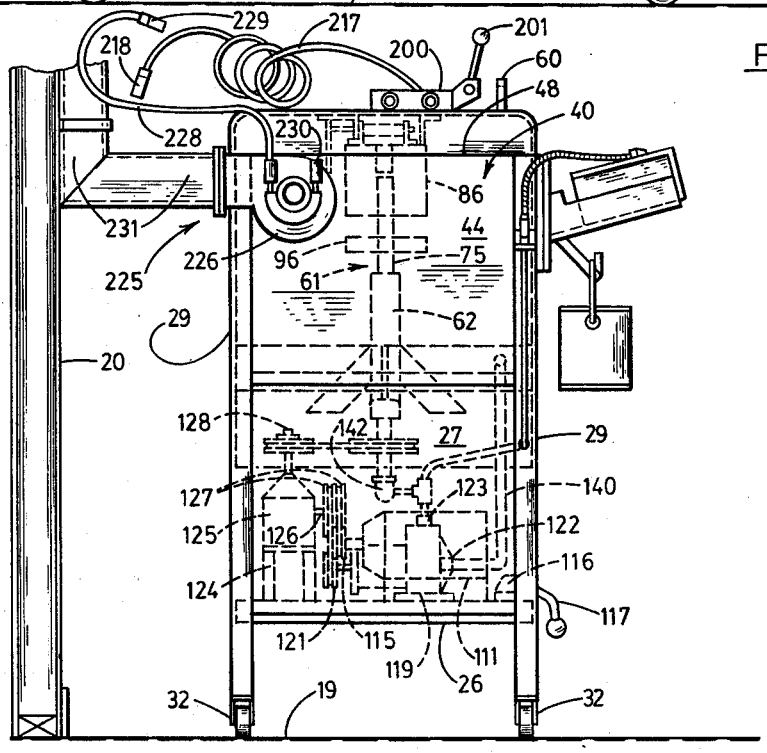
FIG. 2 is a side elevation of the cleaning apparatus shown in the environment of FIG. 1.

The apparatus 10 is shown in FIGS. 1 and 2 in a typical operative environment rested on a floor 19 adjacent to a wall 20.

The cleaning apparatus 10 has a rigid metal frame 25. The frame has a platform 26 on which are affixed four upstanding side walls 27 to form a box-like enclosure 28. The enclosure is mounted on and extends between four substantially parallel legs 29. Each leg individually mounts a wheel assembly 32 for rolling engagement with the floor 19 or a similar supporting surface. A tank 40 is secured in the frame 25 above the enclosure and in spaced relation to the platform 26. The tank has a sloped floor or bottom wall 41 and four side walls 44 disposed in upstanding relation on the floor and sealed thereto in fluid tight relation along their common edges. The side walls and bottom wall therefore define an internal receptacle 47 for the tank. The side walls have corresponding upper edges 48 which bound an opening 49 serving as an entrance to the receptacle 47. The tank is adapted to receive and hold a suitable quantity of a solvent 50. Although a number of types of solvents can be employed, lacquer thinner is particularly well suited to the purpose as will hereinafter be described.

A lid or closure 56 is fastened on the tank 40 by a pair of hinges, not shown, for movement from the closed position shown in FIGS. 1, 2, 4, 5 and 6 to an opened position, not shown, in which the opening 49 of the tank is completely exposed allowing access to the receptacle 47. The closure has a flat central portion 57 with an exterior surface 58 and an interior surface 59. A handle 60 is affixed on the exterior surface 58 of the closure 56 for use in moving the closure between the opened and closed positions.

A pair of cleaning assemblies 61 are mounted on the bottom wall 41 of the tank 40 in spaced, upstanding relation as can best be seen in hidden lines in FIGS. 1 and 2. It will become apparent that only one such cleaning assembly, or, alternatively, more than two cleaning assemblies can be employed depending upon the number of containers 11 preferred to be cleaned during a single cleaning operation.

Each of the cleaning assemblies 61 has a shaft mounting assembly 62 secured on the bottom wall 41 of the tank 40 in upstanding relation. A tubular shaft 75 is mounted for rotational movement in each of the shaft mounting assemblies. Each tubular shaft has a passage, not shown, extending the length thereof. Each of the shafts has a first or lower end portion 77 extending through the bottom wall 41 of the tank externally thereof and an opposite second or upper end portion 78 extending above its respective shaft mounting assembly 62 within the receptacle 47. Each cleaning assembly mounts its respective tubular shaft for rotation about a predetermined axis of rotation 80.

Figure 4:
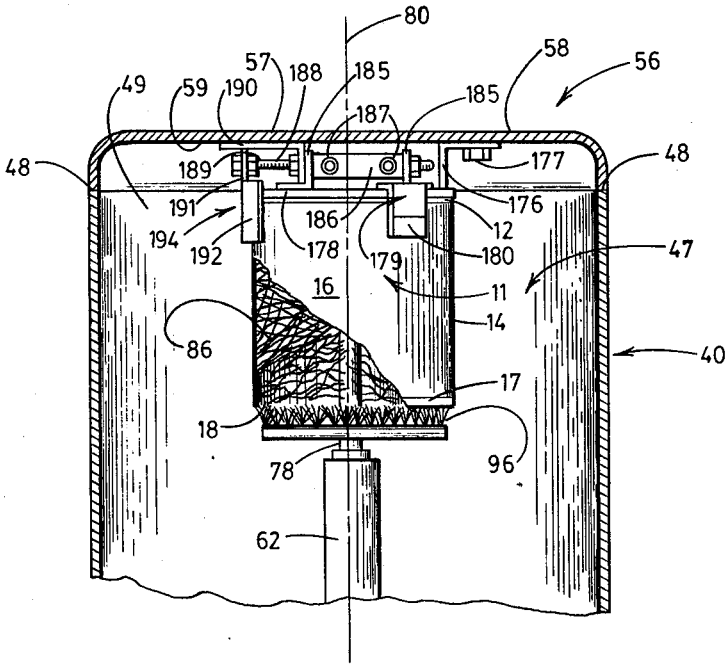
FIG. 4 is a fragmentary transverse vertical section taken from a position indicated by line 4—4 in FIG. 1 and fragmentarily showing a container received in position for cleaning.

A brush assembly 85 is secured on the second end portion 78 of each tubular shaft 75. Each brush assembly has a first brush 86 affording a plurality of holes, not shown, extending therethrough into communication with the internal passage of its respective tubular shaft at the second end portion thereof. A second brush 96 is borne by each tubular shaft adjacent to the first brush thereof. Each brush assembly and therefore the first and second brushes 86 and 96 thereof is affixed on its respective shaft for rotation therewith. The first and second brushes of each brush assembly are dimensioned and arranged for engagement with the interior surface 15 and the annular lip 17 of the container 11, as best shown in FIG. 4, during operation of the apparatus 10.

A drive system 110 for the apparatus 10 is mounted within the enclosure 28 and can be of any suitable type. As shown in the drawings, an electric motor 11, having an electric cable 112 with an electric plug 13 at the remote end thereof, is mounted on the platform 26 on the left, as viewed in FIG. 1. The electric motor mounts a pulley 115 in driven relation thereon. A microswitch 116, operated by a foot lever 117, is affixed on the platform 26 with the foot lever extending through the adjacent side wall 27. The microswitch is operably connected to the motor by an electric cable 118. Depression of the foot lever of the microswitch acts to initiate and, alternatively, terminate operation of the electric motor. A fluid pump 119 is secured on the platform 26 on the right, as viewed in FIG. 1. The pump mounts a pulley 121 disposed in substantial alignment longitudinally of the enclosure with the pulley 115 of the electric motor 111. A mount 124 is affixed on the platform between and laterally of the motor and pump. A gear box 125 is borne by the mount 124. The gear box has an input shaft 126 on which are mounted a pair of pulleys 127 for rotation with the shaft. The gear box has an output shaft 128 which is substantially parallel to the tubular shafts 75. A gear box drive belt 129 interconnects the pulley 115 of the electric motor 111 and one of the pair of pulleys 127 of the input shaft 126. A pump drive belt 130 interconnects the other of the pair of pulleys 127 and the pulley 121 of the pump 119. Thus, the electric motor is operable to drive the gear box and the pump. The output shaft 128 of the gear box and the first end portions 77 of the tubular shafts 75 individually mount alloys 131 aligned in substantially coplanar relation, as best shown in FIG. 1. A brush drive belt 132 is extended in driving relation about the pulleys 131 so that rotation of the output shaft 128 causes rotation of the tubular shafts 75.

A first conduit assembly or intake conduit 140 is extended through the bottom wall 41 of the tank 40 and affixed on the intake connection 122 of the pump 119 so as to interconnect the interior of the tank and the intake connection in fluid transferring relation. A rotating coupling or union 142 is mounted on the first end portion 77 of each tubular shaft 75. Thus, the shafts 75 are free to rotate in their respective unions 142 while permitting fluid to be transferred therethrough. A pipe 146 interconnects the couplings 142 permitting fluid transfer therebetween. A pipe 147 is mounted on and extended from the coupling 142 on the right, as viewed in FIG. 1, and mounts a tee coupling 148 on the remote end thereof. A pipe 149 interconnects the tee coupling 148 and the discharge connection 123 of the pump 119. Thus, it will be seen that the pump is operable to draw fluid 50 through the first conduit assembly 140 from the tank 40, and to pump the fluid through the pipes 149, 147 and 146, through the rotating couplings 142 and upwardly through the shafts 75 for discharge outwardly through the holes of the first brushes 86 thereof.

A faucet 150 is mounted on the side wall 44 of the tank 40 on the right as viewed in FIG. 1. The faucet is mounted on the side wall adjacent to the bottom wall 41 and has a handle 151 which can be operated to discharge fluid 50 from the receptacle 47 of the tank 40 when desired.

Figure 3:
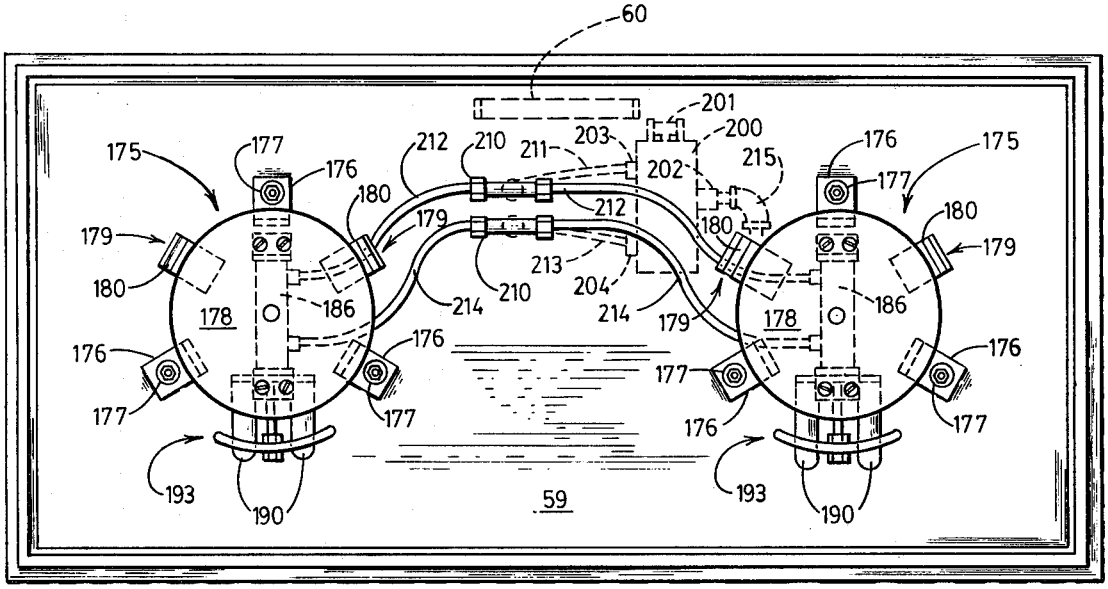
FIG. 3 is a somewhat enlarged horizontal section taken on line 3—3 in FIG. 1.

The cleaning apparatus 10 has a pair of grasping assemblies 175 which constitute one of the primary improvements in the device of the present invention. As best shown in FIG. 3, each of the grasping assemblies has three angle brackets 176 which are fastened in position by bolt and nut assemblies 177 in spaced relation to each other on the interior surface 59 of the closure 56. The brackets of each grasping assembly are preferably mounted in positions disposed one hundred and twenty degrees apart in substantially equally spaced relation to the predetermined axis 80 of its respective cleaning assembly 61 when the closure 56 is in the closed position shown in FIG. 4. A circular base plate 78 is mounted on the angle brackets 176 of each grasping assembly in substantially parallel spaced relation to the interior surface 59 of the closure and substantially concentric to the predetermined axis 80 of its respective cleaning assembly 61 when the closure is in the closed position. A pair of angle iron first gripping members or stops 179 are secured, as by welding, on each base plate disposed approximately one hundred and twenty degrees from each other about the base plate, as best shown in FIG. 3. Each of the stops 179 has a stop portion 180 extending downwardly from the base plate away from the interior surface 59 of the closure. The stop portions are oriented so as to be spaced from the axis 80, when the closure is in the closed position, a distance substantially equal to that of the radius of the bottom wall 12 of the container 11 to be cleaned.

Each of the base plates 178 mounts a pair of mounting brackets 185 which are aligned in spaced relation to each other between the base plate and the interior surface 59 of the closure 56. A pneumatic cylinder 186 is mounted on and extends between the mounting brackets 185 of each pair as best shown in FIG. 4. Each pneumatic cylinder has a pair of hose connections 187 individually adjacent to the opposite ends thereof. A piston rod 188 is borne by each pneumatic cylinder and operatively extends into its respective cylinder mounting a piston, not shown, within the cylinder in the conventional manner. The piston rod has a remote end 189. A guide plate 190 is fastened on the mounting bracket 185 adjacent to the piston rod of each grasping assembly and extends along the interior surface 59 of the closure. A second gripping member 191 is mounted on the remote end 189 of each piston rod for movement therewith in sliding engagement with the guide plate 190. The second gripping member extends at right angles to the piston rod away from the closure to form a concave gripping portion 192 disposed at substantially one hundred and twenty degrees from its respective first gripping members 179, as can best be seen in FIG. 3. Each pneumatic cylinder 186 is operable to extend and retract its piston rod so as to move the gripping portion of the gripping member through an extended or release position 193 shown in FIG. 3, a gripping position 194 shown in FIG. 4 and a fully retracted position, not shown, in which the gripping portion engages the edge of the base plate 178.

The apparatus 10 has a pneumatic system 199. The pneumatic system includes a control valve 200 which is mounted on the exterior surface 58 of the closure 56. The control valve has a control lever 201 which is selectively positionable to operate the valve. The valve has an intake hose connection 202, a first outlet hose connection 203 and a second outlet hose connection 204.

Figure 7:
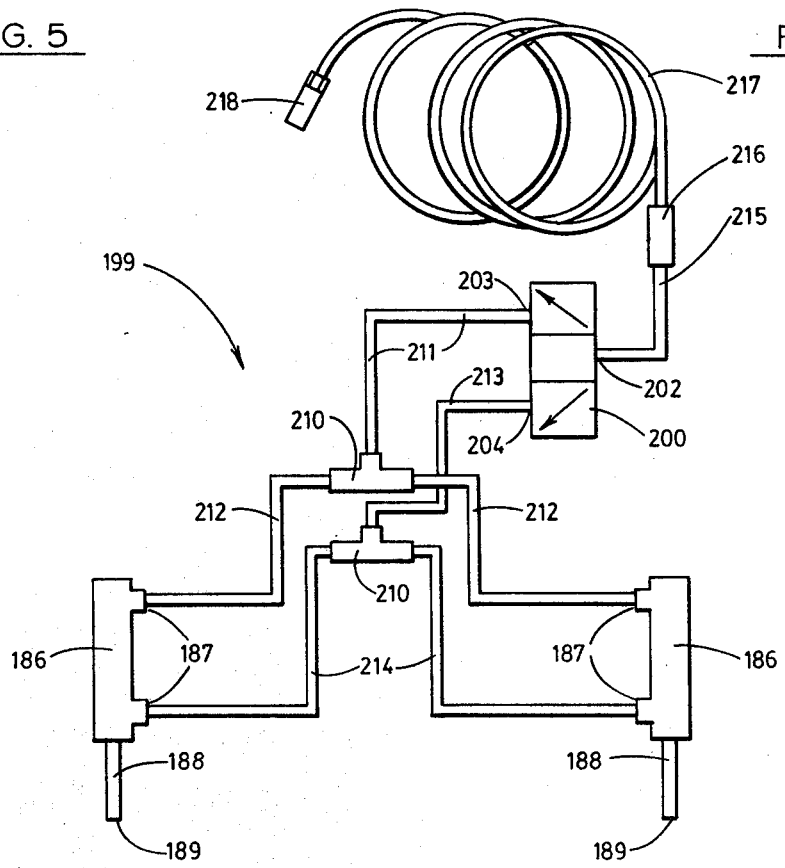
FIG. 7 is a schematic diagram of the pneumatic system of the present invention.

A pair of tee couplings 210 are affixed on and extend through the central portion 57 of the closure 56 in side-by-side relation. A first hose 211 operatively interconnects the first outlet hose connection 203 and one of the tee couplings. A pair of second hoses 212 individually operatively interconnect the available couplings of the tee coupling to which the first hose is connected and the hose connections 187 of the pneumatic cylinders 186 remote from their respective piston rods 188. A third hose 213 operatively interconnects the second outlet hose connection 204 of the control valve and the other of the tee couplings 210. A pair of fourth hoses 214 individually operatively interconnect the available connections of that tee coupling and the hose connections 187 of the pneumatic cylinders 186 nearest their respective piston rods 188, as best shown in FIGS. 3 and 7. An air supply conduit 215 is operatively connected to the intake connection 202 of the control valve. A pressure regulator 216 is mounted on the conduit. The pressure regulator is employed to control the pressure of air supplied to the control valve 200 for purposes subsequently to be described. A hose 217 is mounted on the pressure regulator and has a coupling 218 at the remote end thereof for connection to a suitable source of compressed air or a similar gas, not shown. Thus, compressed air is supplied to the control valve from the source at a pressure selected using the pressure regulator.

The cleaning apparatus 10 has an exhaust system 225. The exhaust system includes a pneumatic fan 226 mounted on a side wall 44 of the tank 40 in communication with the receptacle 47 through an intake opening 227 extending through the side wall for the vacuumatic attraction of fumes from within the receptacle. An air supply conduit 228 is connected to the fan for the supply of air under pressure thereto in driving relation to the fan. The air supply conduit has a coupling 229 at the remote end thereof for connection to a suitable source of air under pressure for purposes of driving the fan. The fan has an air discharge 230 through which air under pressure is discharged so as to create a path of air movement through the fan in driving relation thereto. An exhaust duct 231 is extended from the fan in receiving relation to fumes from witin the receptacle. The duct is extended to a suitable location for discharge of the fumes. As suggested in FIG. 2, it has been found convenient to extend the duct through an adjoining wall such as wall 20 so as to vent the fumes to the exterior of the building within which the cleaning apparatus is employed. Thus, the fan is driven pneumatically to withdraw fumes from the receptacle 47, through the intake opening 227 and exhaust duct 231 for discharge.

Figure 5:
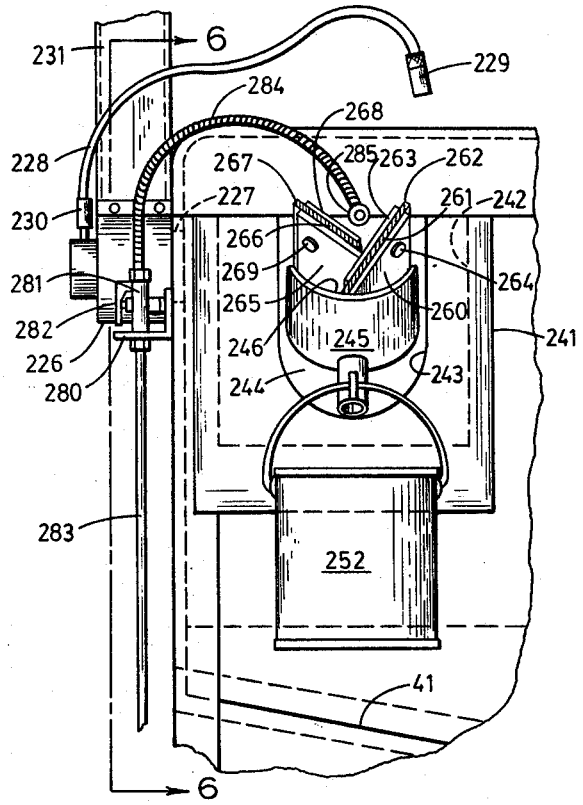
FIG. 5 is a somewhat enlarged fragmentary view of the cleaning apparatus showing the pre-cleaning assembly and exhaust system of the present invention.
Figure 6:
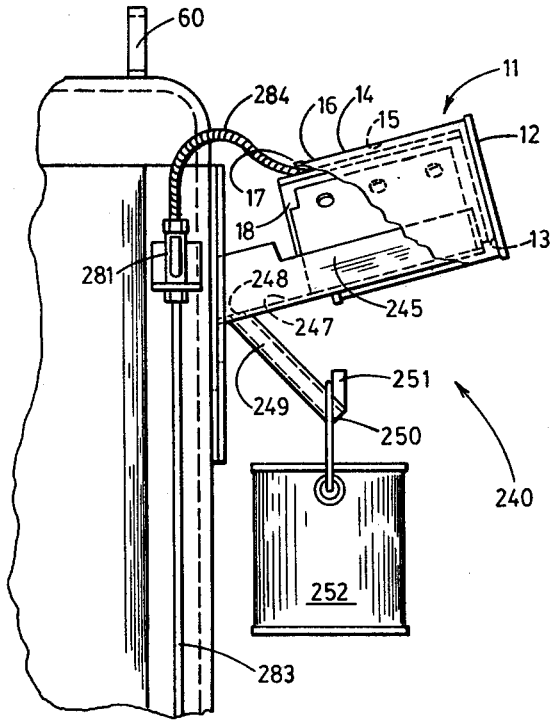
FIG. 6 is a fragmentary side elevation taken from a position indicated by line 6—6 in FIG. 5 and fragmentarily showing a container received on the pre-cleaning assembly.

The cleaning apparatus 10 has a pre-cleaning assembly 240, best shown in FIGS. 5 and 6. The pre-cleaning assembly has a mount 241 which is secured on the side wall 44 of the tank 40 and defines an internal receptacle 242. A recess 243 extends through the mount into communication with the receptacle as best shown in FIG. 5. A mounting plate 244 is slidably received in the receptacle 242 of the mount. A trough 245, having a concave interior surface 246, is secured, as by welding, on the mounting plate so as to extend through the recess 243 of the mount upwardly inclined therefrom, as shown in FIG. 6. The interior surface 246 defines a sloped passage 247 communicating with a drain opening 248 adjacent to the mounting plate at the lower end of the trough. A drain pipe 249 is mounted on and extends downwardly from the trough in communication with a drain opening 248. The drain pipe has a remote end 250 mounting an upwardly extending support 251. As shown in FIGS. 5 and 6, the support is adapted to receive a can 252 or similar article for the receipt of fluid material discharged from the drain pipe.

A first mounting plate 260 is secured, as by welding, on the interior surface 246 of the trough 245 extending substantially upwardly and to the right as viewed in FIG. 5. The plate 260 preferably extends longitudinally of the trough. A cleaning panel 261, preferably constructed of rubber or another suitable resilient material, is received in facing engagement with the mounting plate with an edge 262 thereof extending beyond the remote edge of the mounting plate. A first cover plate 263 is received in facing engagement with the cleaning panel and is releasably held in position by bolt and nut assemblies 264 extending through the mounting plate, cleaning panel, and cover plate to capture the cleaning panel in the position described. A second mounting plate 265 is borne by the first cover plate 263 disposed at an angle of approximately ninety degrees with respect to the cover plate. A second cleaning panel 266 is disposed in facing engagement with the second mounting plate with an edge 267 thereof extending beyond the remote edge of the second mounting plate, as best shown in FIG. 5. A second cover plate 268 is received in facing engagement with the cleaning panel and is held in position by bolt and nut assemblies 269 to capture the cleaning panel in the position described. The cleaning panels 261 and 266 and the edges thereof are thus disposed at an angle of approximately ninety degrees with respect to each other and approximately forty-five degrees on opposite sides of vertical. The angle of the panels from each other is preferably within the range of from sixty degrees to one hundred and eighty degrees.

A mounting bracket 280 is fastened on a side wall 44 of the tank 40 adjacent to the trough 245. A normally closed release valve 281 is affixed on the mounting bracket and has a control lever 282 which is operable to open the release valve to discharge fluid therethrough. A connection hose 283 operatively interconnects the tee coupling 148 communicating with the pump 119 and the release valve 281, as best shown in FIG. 1. A metal hose 284 is mounted on the release valve on the discharge side thereof and has a discharge nozzle 285 on its remote end. As can best be visualized in FIGS. 1, 5 and 6, the metal hose is adapted to be disposed in an attitude whereby the discharge nozzle is positioned between the first and second cleaning panels 261 and 266.

OPERATION

The operation of the described embodiment of the subject invention is believed to be clearly apparent and is briefly summarized at this point. The cleaning apparatus 10 is used in a manner somewhat similar to that of the cleaning apparatus of the applicant's aforementioned co-pending patent application Ser. No. 757,203.

However, in the cleaning apparatus of the present invention, the pre-cleaning assembly 240 is normally used first particularly where paint, lacquer or the like has hardened onto the interior surfaces 13 and 15 of the container 11 to be cleaned. Such hardened substances are often difficult to remove. With the plug 113 inserted in a suitable electrical outlet, not shown, and the foot lever 117 is depressed to operate the microswitch 116 in order to activate the apparatus. This causes the pump 119 to be operated to pump the fluid 50, preferably lacquer thinner or a similar solvent, from the receptacle 47 and through the cleaning assemblies 61 by way of pipes 146, 147 and tubular shafts 75. The fluid is continually recirculated through the apparatus in this manner. Similarly the pump operates to supply the fluid through the connection hose 283 to the normally closed release valve 281.

The operator positions the container 11 to be cleaned about the pre-cleaning assembly 240 as shown fragmentarily in FIG. 6 so that the interior surface 15 of the cylindrical side wall 14 rests on the edges 262 and 267 of the cleaning panels 261 and 266. The container is disposed so that the cylindrical side wall 14 of the container is extended about the trough 245. With care taken to insure that the nozzle 285 of the metal hose 284 is positioned so as to discharge the solvent or fluid 50 onto the interior surface 15 of the container, the control lever 282 is depressed to open the release valve 281 thereby discharging the fluid on to the interior surface. The release valve can be held open or operated intermittently as necessary to supply sufficient fluid for pre-cleaning of the surface. The operator rotates the container so as to scrape the edges 262 and 267 against the interior surface of the side wall. In the presence of the fluid this operation acts to loosen and remove such of the hardened substances from the interior surface. Since the edges of the cleaning panels are disposed approximately ninety degrees apart, the edges themselves afford a basis for support of the container and the container can be pressed downwardly so as to insure a positive cleaning or scraping action. The substances removed from the container and the fluid flow downwardly along the sloped passage 247, out the drain opening 248 and drain pipe 249 and into the can 252 on the support 251. When the can has been filled, the substances within the container 252 are simply disposed of in any suitable manner.

The container 11 which has been pre-cleaned, is then ready for the main cleaning operation within the tank 40 of the cleaning apparatus 10. The grasping assemblies 175 are at this time disposed in their "at rest" attitudes with their respective second grasping members 191 in the extended positions 193. The operator, using the handle 60, raises the closure 56 to the opened position. The container 11 is positioned downwardly about one of the brush assemblies 85 so that it is positioned as shown in FIG. 4 with the annular lip 17 in engagement with the second brush 96 and the interior surface 15 of the side wall in engagement with the first brush 86. The operator then returns the closure 56 to the closed position. Such positioning of the closure causes the stop portions 180 of the first gripping members 179 to slide downwardly against the side wall 14 of the container and the circular base plate 178 to engage the bottom wall 12 of the container, as shown in FIG. 4. The operator then positions the control lever 201 of the control valve 200 in position for operation of the grasping assemblies. Compressed air passes from the source through the supply conduit 215, the third hose 213, the pair of fourth hoses 214 and into the pneumatic cylinders 186 to cause the piston rods 188 to be retracted. Such retraction causes the gripping portions 192 of the second gripping members to be drawn into the gripping positions 194 wherein the container is firmly grasped between the first and second gripping members. It will be seen that such movement of the second gripping member instantaneously forces the container against the first gripping members and thus into substantially precise concentricity with the axis 80 of its respective brush assembly. The pressure regulator 216 can be adjusted so that the force exerted against the container by the second gripping member is sufficient securely to retain the container in position without crushing or otherwise damaging it.

Thereafter, the operator trips the foot lever 117 to operate the apparatus to rotate the brush assemblies 85 by means of the electric motor 111 and gear box 125. Rotation of the first and second brushes 86 and 96 respectively about the axis 80 with the container held in a position concentric to the axis, and the supply of fluid solvent discharged outwardly through the brushes operates rapidly to clean the container for subsequent reuse. After passage of a sufficient period of time to accomplish such cleaning, the foot lever 117 is again tripped to stop operation of the apparatus. Thereafter, the operator simply moves the control level 201 of the control valve 200 to the alternate position to move the gripping portions 192 to the extended positions 193 thereby releasing the container. Subsequently, the operator raises the closure and removes the cleaned container from the brush assembly 85 for use.

During both operation and inoperation of the apparatus, it is desirable to allow the exhaust system 225 to operate to remove toxic, explosive, or flammable fumes from the receptacle 47. Since the fan itself is operated pneumatically, the risk of explosion or fire with the use of hazardous fluids 50 is reduced to a minimum.

Therefore, the cleaning apparatus of the present invention insures the rapid, precise and secure positioning and grasping of containers for cleaning; provision for the loosening and removal of hardened substances prior to the main cleaning operation; and provision for exhausting fumes from the apparatus during operation thereby providing an apparatus of markedly superior performance.

Although the invention has been herein shown and described in what is conceived to be the most practical and preferred embodiment, it is recognized that departures may be made therefrom within the scope of the invention, which is not to be limited to the illustrative details disclosed.

Having described my invention what I claim as new and desire to secure by Letters Patent is:

1. An apparatus for cleaning containers bearing paint or the like, the apparatus comprising a housing; a cleaning assembly mounted within the housing; grasping means, having predetermined grasping and releasing modes, borne by the apparatus for holding, in said grasping mode, a container to be cleaned in position for cleaning by said cleaning assembly; a pressure system operably connected to the grasping means; control means for operating the pressure system selectively to dispose the grasping means in said grasping and releasing modes; means for driving the cleaning assembly; and means for pumping a solvent to the cleaning assembly during operation of the apparatus and exhaust means mounted on the housing in communication with the interior thereof for removing gases therefrom.

2. An apparatus for cleaning containers bearing paint or the like, the apparatus comprising a housing; a cleaning assembly mounted within the housing; grasping means, having predetermined grasping and releasing modes, borne by the apparatus for holding, in said grasping mode, a container to be cleaned in position for cleaning by said cleaning assembly; a pressure system operably connected to the grasping means; control means for operating the pressure system selectively to dispose the grasping means in said grasping and releasing modes; means for driving the cleaning assembly; means for pumping a solvent to the cleaning assembly during operation of the apparatus; and a pre-cleaning assembly borne by the apparatus and having a portion disposed for cleaning engagement with one of said containers prior to cleaning by said cleaning assembly and including a conduit extended from the pumping means to a position for supplying solvent to the container.

3. In an apparatus for cleaning substantially cylindrical containers bearing paint or the like, the apparatus having a cleaning assembly mounted for movement relative to a predetermined axis; and means for moving the cleaning assembly in said relative movement; an improvement having an operative mode, the improvement comprising a first gripping member borne by the apparatus for disposal in said operative mode in fixed position in predetermined spaced relation to said axis of the apparatus a distance substantially equal to the radius of the container; a second gripping member borne by the apparatus for movement in said operative mode along a path in the operative mode toward and from said axis in spaced relation to the first gripping member from a position spaced from said axis a distance greater than the radius to a position spaced from the axis a distance less than the radius; means for moving the second gripping member along said path and into gripping engagement with a container received on said cleaning assembly to capture said container in fixed position between the gripping members; and wherein the cleaning assembly of the apparatus is mounted in a housing having a closure movable between opened and closed positions and said gripping members are borne on the closure positioned in said operative mode when the closure is in the closed position.

4. The improvement of claim 3 wherein said moving means includes a pneumatic cylinder connected in driving relation to said second gripping member and a pneumatic system is connected to said cylinder having means for adjusting the pressure applied in moving the second gripping member along said path to insure positive retention of the container in fixed position between the gripping members in the operative mode without damage to the container.

5. The improvement of claim 4 wherein said discharging means includes a conduit extending from the pumping system to a remote end disposed between said portions of the pair of assemblies, a nozzle is borne by said remote end of the conduit for releasing said solvent against the internal surface of a container received about the trough and a control valve is mounted on the conduit operable selectively to discharge said solvent through the conduit from the pumping system.

6. The improvement of claim 4 including an exhaust fan mounted on the apparatus in communication with the interior thereof, a pneumatic conduit interconnecting said pneumatic system and the exhaust fan to drive said fan to withdraw gases from within the apparatus and a duct interconnecting the fan and a discharge area for the transmission of said gases thereto.

7. In an apparatus for cleaning containers each having a substantially cylindrical internal surface to be cleaned bearing paint or the like, the apparatus having a cleaning assembly mounted for movement relative to a predetermined axis; and means for moving the cleaning assembly in said relative movement; an improvement having an operative mode, the improvement comprising a first gripping member borne by the apparatus for disposal in said operative mode in fixed position in predetermined spaced relation to said axis of the apparatus; a second gripping member borne by the apparatus for movement in said operative mode along a path toward and from said axis in spaced relation to the first gripping member; means for moving the second gripping member along said path and into gripping engagement with a container received on said cleaning assembly to capture said container in fixed position between the gripping members; a trough borne by the apparatus and dimensioned for receipt in said container; means borne by the trough for engaging the internal surface of the container in supporting relation thereto whereby the container can be rotated about the trough; and engaging means for initial cleaning of the internal surface by said engaging means prior to the container being received on the cleaning assembly.

8. The improvement of claim 7 wherein said engaging means include a pair of assemblies secured on the trough having portions disposed for engagement with said internal surface of the container at positions spaced from each other substantially within the range of from sixty to one hundred and eighty degrees to support said container during rotation about the trough.

9. The improvement of claim 8 wherein the cleaning apparatus has a pump system operable to supply a cleaning solvent to the cleaning assembly during said relative movement and the improvement includes means connected to the pump system and extending to a position in proximity to the trough for discharging solvent from the pump system within the container received on the trough.

10. The improvement of claim 9 wherein the trough is beneath said pair of assemblies in receiving relation to solvent, paint or the like, the trough is sloped downwardly in feeding relation to a drain passage and a support is borne by the trough in position to hold a receptacle in gravitationally receiving relation to the drain passage.

* * * * *

UNITED STATES PATENT AND TRADEMARK OFFICE

CERTIFICATE OF CORRECTION

PATENT NO. : 4,173,053

DATED : November 6, 1979

INVENTOR(S) : Robert N. Wills

It is certified that error appears in the above-identified patent and that said Letters Patent are hereby corrected as shown below:

Column 4, line 32, delete "alloys" and substitute ---pulleys---.

Column 8, Line 20, delete "such" and substitute ---much---.

Signed and Sealed this

*Twelfth* Day of *February 1980*

[SEAL]

*Attest:*

SIDNEY A. DIAMOND

*Attesting Officer*

*Commissioner of Patents and Trademarks*